US007612632B2

(12) United States Patent
Tanaka et al.

(10) Patent No.: US 7,612,632 B2
(45) Date of Patent: Nov. 3, 2009

(54) LINE-WAVEGUIDE CONVERTER HAVING PLURAL ELECTRODE CELLS AND RADIO COMMUNICATION DEVICE USING SUCH A CONVERTER

(75) Inventors: Makoto Tanaka, Obu (JP); Kazuoki Matsugatani, Kariya (JP); Kook Joo Lee, Uijeongbu (KR); Dowon Kim, Seoul (KR); Moonil Kim, Seoul (KR)

(73) Assignee: Denso Corporation, Kariya, Aichi-Pref. (JP)

( * ) Notice: Subject to any disclaimer, the term of this patent is extended or adjusted under 35 U.S.C. 154(b) by 90 days.

(21) Appl. No.: 11/882,179

(22) Filed: Jul. 31, 2007

(65) Prior Publication Data

US 2008/0030284 A1 Feb. 7, 2008

(30) Foreign Application Priority Data

Aug. 1, 2006 (JP) ..... 2006-209631

(51) Int. Cl.
*H01P 5/103* (2006.01)
*H01P 5/107* (2006.01)

(52) U.S. Cl. ..... 333/26

(58) Field of Classification Search ..... 333/26
See application file for complete search history.

(56) References Cited

U.S. PATENT DOCUMENTS 6,262,495 B1 7/2001 Yablonovitch et al.
6,822,528 B2 * 11/2004 Dawn et al. ..... 333/26
2003/0231078 A1 * 12/2003 Koriyama et al. ..... 333/26
2006/0091971 A1 * 5/2006 Tahara et al. ..... 333/26

OTHER PUBLICATIONS

Korean Office Action dated Aug. 27, 2008 issued in counterpart Korean Application 10-2007-0076792 with English translation.

* cited by examiner

*Primary Examiner*—Benny Lee
(74) *Attorney, Agent, or Firm*—Nixon & Vanderhye PC

(57) ABSTRACT

A line-waveguide converter includes a backside electrode disposed on a first face of a dielectric substrate, a waveguide attached to a second face of the dielectric substrate opposite the first face and having electrical conduction to the backside electrode, and multiple electrodes disposed inside the waveguide on the second face. The electrodes are identical in shape and size, and the intervals between adjoining ones of the electrodes are identical. At least one of the electrodes can be fed with power from a line.

17 Claims, 13 Drawing Sheets

LINE-WAVEGUIDE CONVERTER HAVING PLURAL ELECTRODE CELLS AND RADIO COMMUNICATION DEVICE USING SUCH A CONVERTER

CROSS REFERENCE TO RELATED APPLICATION

This application is based on and incorporates herein by reference Japanese Patent Application No. 2006-209631 filed on Aug. 1, 2006.

FIELD OF THE INVENTION

The present invention relates to a line-waveguide converter and a radio communication device equipped with a line-waveguide converter.

BACKGROUND OF THE INVENTION

Various kinds of devices are used conventionally as line-waveguide converters for converting transmission signals between a signal line and a waveguide. For example, JP 8-139504A discloses a line-waveguide converter, in which a waveguide is excited by a patch antenna. Further, JP 6-112708A discloses another line-waveguide converter, in which a back short is used and a line is laterally disposed in the direction of signal propagation in a waveguide.

SUMMARY OF THE INVENTION

An object of the invention is to provide an improved line-waveguide converter.

According to a first aspect, a line-waveguide converter includes: a first face electric conductor disposed on a first face of a dielectric substrate; a waveguide attached to a second face of the dielectric substrate opposite the first face and electrically communicating with the first face electric conductor; and multiple electrodes disposed inside the waveguide on the second face. In this line-waveguide converter, the electrodes are identical with one another in shape and size. The intervals between adjoining ones of these electrodes are identical, and at least one of the electrodes is fed with power from a line.

Thus, the electrodes of the same shape and size are arranged at equal intervals inside the waveguide on the second face of the dielectric substrate, and the first face electric conductor is bonded to the first face of the dielectric substrate. The electrodes are fed with power from the line, so that the waveguide is thereby excited.

When the total number of the multiple electrodes is two, there is only one interval between the adjoining electrodes. Therefore, the requirement of "the intervals between adjoining ones of these electrodes are identical" is satisfied regardless of how the two electrodes are disposed. The number of the lines may be one, two or more. When there are two or more feeding electrodes, they may be fed with power from separate lines.

This line-waveguide converter may be so constructed that the dielectric substrate is provided with multiple through holes, and the electrodes communicate with the first face electric conductor via the through holes.

The above electrode structure is known as electromagnetic band gap (EBG). The EBG is disclosed in, for example, U.S. Pat. No. 6,262,495. The EBG is a structure formed by: disposing multiple electrodes of the same shape and size at equal intervals on the surface of a dielectric substrate; bonding a conductor to the backside surface of the dielectric substrate; forming through holes penetrating the dielectric substrate for the individual electrodes; and electrically connecting cells on the surface and the conductor on the backside surface via the through holes.

In the EBG, the above structure takes on the characteristics of a circuit in which an inductor and a capacitor are continuously connected. For this reason, it becomes a material (substrate) having high-impedance characteristics in proximity to its resonance frequency because of its LC resonance. Taking advantage of its impedance characteristics, the EBG is conventionally applied to antenna ground and the like for the suppression of unwanted emission.

This first aspect is based on the finding that a waveguide can be excited utilizing the LC resonance of an EBG structure by adjusting the cell size of the EBG structure. As a result, a wide-band line-waveguide converter is realized.

According to a second aspect, a line-waveguide converter includes: a dielectric substrate; a first face electric conductor disposed on a first face of the dielectric substrate; a waveguide attached to a second face of the dielectric substrate opposite the first face and electrically communicating with the first face electric conductor; and electrodes disposed in a repetitive pattern inside the waveguide on the second face. At least one of these electrodes is fed with power from a signal line.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

Figure 1:
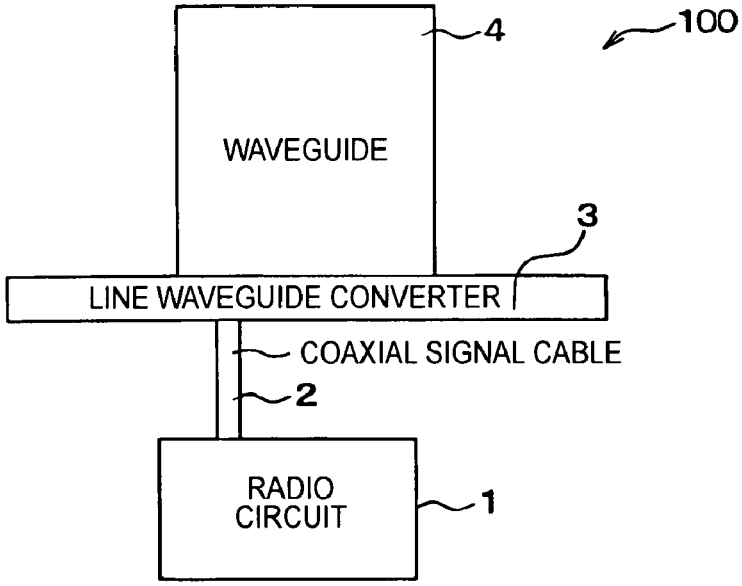
FIG. 1 is a schematic view of a communication device according to first embodiment of the invention.

Referring first to FIG. 1, a radio communication device 100 includes a radio circuit 1, a signal coaxial cable 2 using a coaxial cable, a line-waveguide converter 3, and a waveguide 4. The radio circuit 1 may use publicly known circuitry including, for example, a filter, a local transmitter, a frequency converter, an amplifier, a wave detector, and the like. An output signal from the radio circuit 1 is supplied to the line-waveguide converter 3 through the coaxial cable 2 connected to a backside surface (first face) of the line-waveguide converter 3. The line-waveguide converter 3 converts the signal from the coaxial cable 2 and inputs it to the waveguide 4 provided on a front-side (second face) of the line-waveguide converter 3. Conversely, an input signal from the waveguide 4 passes through the line-waveguide converter 3 and is inputted to the radio circuit 1 by way of the coaxial cable 2. Examples of the communication device 100 include radar devices and radio communication base stations.

Figure 2:
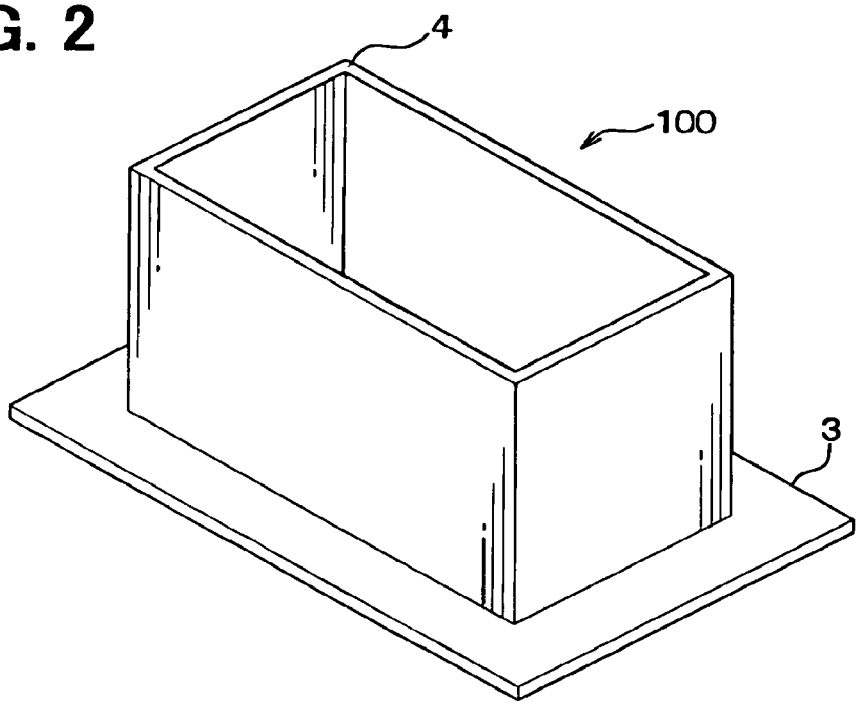
FIG. 2 is a perspective view of a line-waveguide converter and a waveguide in the first embodiment.
Figure 3:
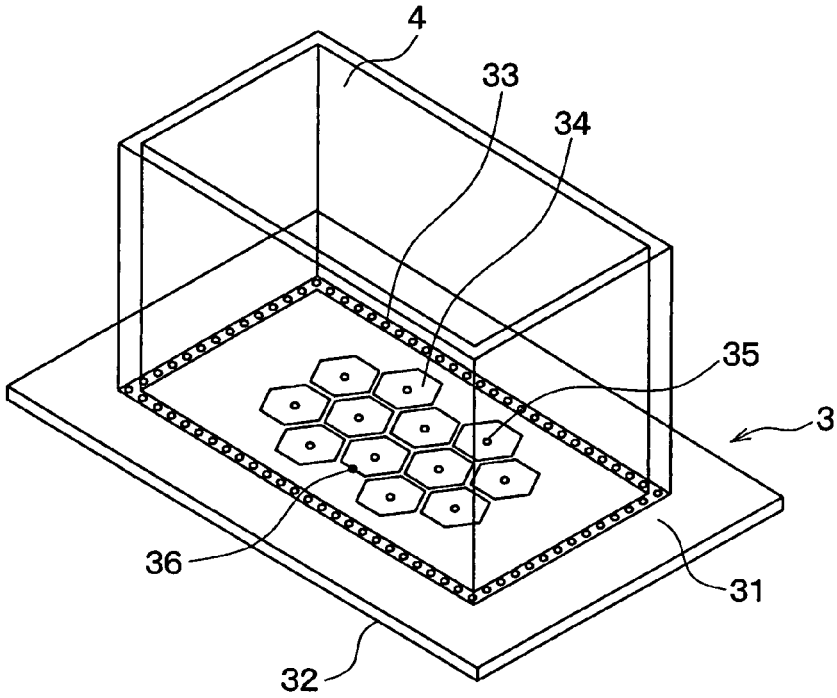
FIG. 3 is a perspective view transparently depicting the waveguide in the first embodiment.

The waveguide 4 (e.g., see FIGS. 1-9, 11, 13, 15-17 and 20) is formed of conductive metal and, as illustrated in FIGS. 2, 3, its one end is in tight contact with the front-side surface of the line-waveguide converter 3. As shown in FIG. 3 the line-waveguide converter 3 (see also FIGS. 4, 6, 7, 16 and 21) includes a dielectric substrate 31, a backside electrode 32 (e.g. see FIGS. 3, 5, 8, 10, 11, 16 and 17), multiple through holes 33 (e.g. see FIGS. 3-5, 7-11, 16 and 18) for the waveguide 4, and multiple cells 34. The backside electrode 32 is a metal film that covers the backside surface of the dielectric substrate 31 (e.g. see also FIGS. 4, 5, 7-9, 11, 15-17. 21, 25 and 26).

Figure 5:
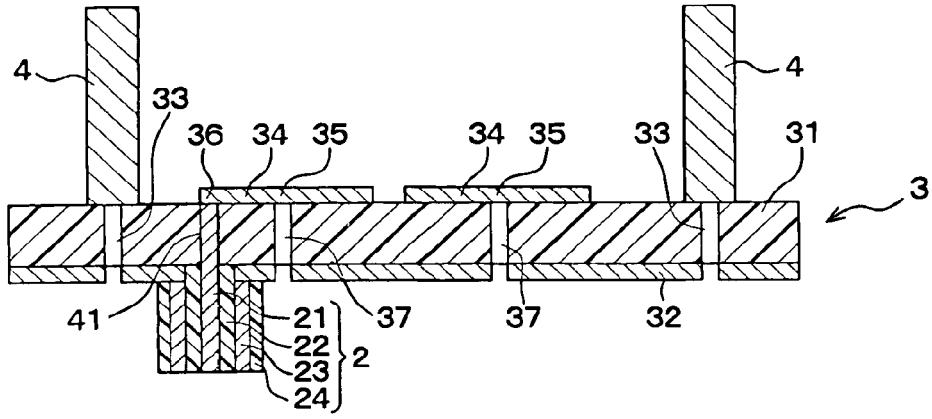
FIG. 5 is a sectional view of the communication device taken along line V-V in FIG. 4.

Each through hole 33 for the waveguide is so provided that it penetrates the dielectric substrate 31 from the backside surface to the front-side surface of the line-waveguide converter 3 as illustrated in FIG. 5. The through holes 33 for the waveguide 4 are disposed at equal intervals on a line on the sides of a rectangle agreeing with the cross sections of the waveguide 4. Each through hole 33 for the waveguide 4 has its inner wall covered with a metal film having conduction to the backside electrode 32. The metal film in the through holes 33 for the waveguide 4 runs to the front-side surface of the dielectric substrate 31. The waveguide 4 is brought into tight contact with the dielectric substrate 31 so that the waveguide 4 is brought into contact with the metal film in the through holes 33 for the waveguide 4. The conduction between the waveguide 4 and the dielectric substrate 31 is thereby maintained.

Figure 4:
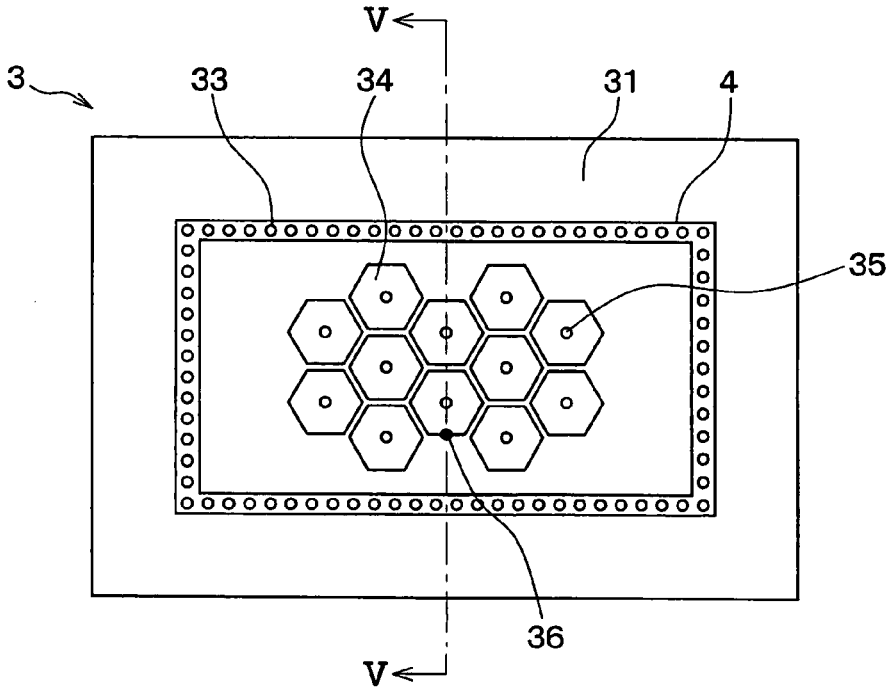
FIG. 4 is a plan view of a line-waveguide converter and a transparently depicted waveguide in the first embodiment.

Each of the cells 34 (e.g. see FIGS. 3-5, 7-9, 11, 12, 15-17, 20, 21 and 25) is a conductive metal electrode, and is stuck to the front-side surface of the dielectric substrate 31 inside the waveguide 4. As illustrated in FIGS. 3-4 each of twelve cells 34 situated inside the waveguide 4 is hexagonal, and they are identical in size. The intervals between adjoining ones of the cells 34 are identical. That is, the cells 34 are disposed in a repetitive pattern inside the waveguide 4.

More specifically, the cells 34 are arranged in five cell rows lined along the long sides of the waveguide 4 inside the waveguide 4 on the front-side surface of the dielectric substrate 31. In each row, two or three cells are lined along the short sides of the waveguide 4. The numbers of cells 34 contained in the individual cell rows are alternately two, three, two, three, and two in the order of alignment of the cell rows along the long sides. Thus, the multiple cells 34 form a honeycomb-like structure.

Each of the cells 34 has a conduction point 35 (e.g. see FIGS. 3-5, 7-11, 15-17 and 20) for providing electrical conduction to the backside electrode 32 (e.g., see also FIGS. 5, 8, 10, 11, 16 and 17) in its center, e.g., in an area within 1/20 of the maximum diameter of the cell 34 from its center.

Only one of the cells 34 is provided with a first feeding point 36 (e.g., see FIGS. 3, 4, 5, 8, 15, 20 and 21). A signal from the coaxial cable 2 (FIG. 5) is supplied from the first feeding point 36 to the cells 34. As illustrated in FIG. 4, the cell provided with the first feeding point 36 is one of the following cells: the two cells situated in the center along the direction of the long sides of the waveguide 4 within the front-side surface of the dielectric substrate 31 perpendicular to the direction of signal propagation in the waveguide 4. The direction of the long sides of the waveguide is the horizontal direction in FIG. 4. The direction of signal propagation in the waveguide 4 is the direction toward the near side of FIG. 4. The cell provided with the first feeding point corresponds to the feeding electrode. Hereafter, this cell will be referred to as a feed cell.

The first feeding point 36 is disposed at an end of the feed cell on a straight line, which runs through the conduction point 35 of the feed cell and is parallel with the direction of the short sides of the waveguide 4 within the front-side surface of the dielectric substrate 31 perpendicular to the direction of propagation in the waveguide 4. The direction of the short sides of the waveguide 4 is the vertical direction in FIG. 4. As illustrated in FIG. 5, the line-waveguide converter 3 further includes multiple through holes 37 (e.g., see also FIGS. 8, 11 and 17) for bringing cells 34 into conduction each other and a through hole 41 for the coaxial cable 2.

Each through hole 37 for bringing the cells into conduction is so provided that it penetrates the dielectric substrate 31 from the backside surface to the front-side surface. The through holes 37 for bringing the cells into conduction are so constructed that their planar disposition agrees with that of the conduction points 35 of the cells 34. The planar disposition of the through holes 37 refers to the disposition of them on a plane parallel with the dielectric substrate 31. The inner walls of the through holes 37 for bringing the cells into conduction are covered with a metal film having conduction to the backside electrode 32. The metal film in the through holes 33 for the waveguide runs to the front-side surface of the dielectric substrate 31. The individual cells 34 are brought into tight contact with the dielectric substrate 31 so that the metal film in the through holes 33 for the waveguide 4 are brought into contact with the conduction points 35. The conduction between the cells 34 and the dielectric substrate 31 via the conduction points 35 is thereby provided.

The through hole 41 for the coaxial cable 2 is so provided that it penetrates the dielectric substrate 31 from the backside surface to the front-side surface for connecting the coaxial cable 2 to the feed cell. The through hole 41 (e.g., see FIGS. 5, 8, 11 and 17) for the coaxial cable 2 is so constructed that its planar disposition agrees with that of the first feeding point 36 of the feed cell. As shown in FIG. 5, an internal conductor 21 of the coaxial cable 2 is inserted into the through hole 41 for the coaxial cable 2 and brought into contact with the first feeding point 36. The conduction between the internal conductor 21 and the feed cell is thereby provided. At this time, conduction is also established between an external conductor 23 around an insulator 22 covering the internal conductor 21 and the backside electrode 32. The external conductor 23 has its exterior covered with an insulator 24.

When a signal is supplied from the radio circuit 1 to the line-waveguide converter 3 through the coaxial cable 2 in the communication device 100 (FIG. 2), the signal is converted into a signal that excites the waveguide 4 by the cells 34 and propagates through the interior of the waveguide 4.

As described, the line-waveguide converter 3 includes: the backside electrode 32 that is disposed on the backside surface of the dielectric substrate 31 and has electrical conduction to the waveguide 4 on the front-side surface; and the multiple cells 34 that are attached to the front-side surface of the dielectric substrate 31 and disposed inside the waveguide 4 on the front-side surface. In this line-waveguide converter 3, the cells 34 are identical with one another in shape and size; the intervals between adjoining ones of the cells 34 are identical, and the feed cell, one of the cells 34, can be fed with power from the internal conductor 21 of the coaxial cable 2.

As described above, the cells 34 of the same shape and size are arranged at equal intervals inside the waveguide 4 on the front-side surface of the dielectric substrate 31. The backside electrode 32 is bonded to the backside surface of the dielectric substrate 31, and the cells 34 are fed with power from the coaxial cable 2. The waveguide 4 is thereby excited.

In this line-waveguide converter 3, the dielectric substrate 31 is provided with the multiple through holes 37 for bringing the cells 34 into conduction. The cells 34 communicate with the backside electrode 32 via the through holes 37 for bringing the cells 34 into conduction.

The above electrode structure is known as electromagnetic band gap (EBG). The EBG is disclosed in, for example, U.S. Pat. No. 6,262,495. The EBG is a structure formed by: disposing multiple cells 34 of the same shape and size at equal intervals on the surface of a dielectric substrate 31; bonding a conductor 32 to the backside surface of the dielectric substrate 31; forming through holes 37 penetrating the dielectric substrate 31 for the individual cells 34; and electrically connecting the cells 34 on the surface with the conductor 32 on the backside surface via the through holes 37.

In the EBG, the above structure takes on the characteristics of a circuit in which an inductor (L) and a capacitor (C) are connected in succession. For this reason, it becomes a material (substrate) having high-impedance characteristics in proximity to its resonance frequency because of its LC resonance. Taking advantage of its impedance characteristics, the EBG has been conventionally applied to antenna ground and the like for the suppression of unwanted emission.

The present inventors have found that a waveguide can be excited utilizing LC resonance of an EBG structure by adjusting the cell size of the EBG structure. As a result, the present inventors realized a wide-band line-waveguide converter.

The through holes 37 for bringing the cells 34 into conduction are so constructed that the positions of the through holes 37 agree with the positions of the conduction points 35 situated in the centers of the respective different cells 34 within the range of an allowable error (e.g., 1/20 of the diameter of the cells). With this construction, signals from the coaxial cable 2 to the waveguide 4 can be more efficiently converted.

The first feeding point 36 at which the internal conductor 21 of the coaxial cable 2 has conduction to the feed cell is situated on a straight line. The straight line runs through a point at which the feed cell has conduction to the backside electrode 32 and is parallel with the short sides of the waveguide 4 within a plane perpendicular to the direction of signal propagation in the waveguide 4. With this construction, the electric field of the cells 34 can be excited in parallel with the electric field of the waveguide 4. Therefore, signals from the coaxial cable 2 to the waveguide 4 can be more efficiently converted.

The feed cell is one of the cells 34 that is situated in the center in the direction of the long sides of the waveguide 4 within a plane perpendicular to the direction of signal propagation in the waveguide 4. With this construction, the electric field excited by the multiple cells 34 becomes symmetrical, and impedance matching can be more easily achieved.

Figure 8:
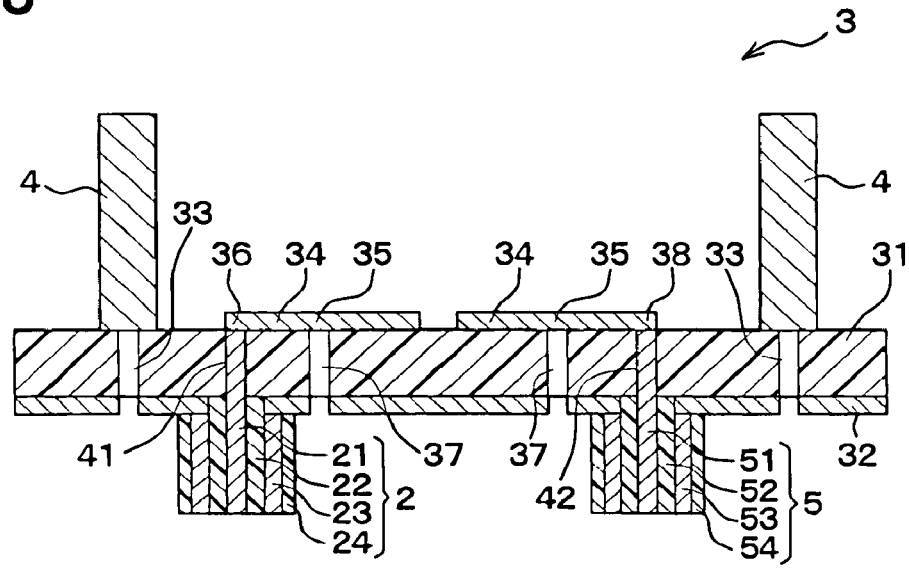
FIG. 8 is a sectional view of the communication device taken along line VIII-VIII of FIG. 7.

The external conductor 23 (e.g., see FIG. 8) of the coaxial cable 2 (e.g., see FIG. 8) has conduction to the backside electrode 32. The internal conductor 21 (e.g., see FIG. 8) continues from the first face to the feed cell via the through hole 41 for the line provided in the dielectric substrate 31. The conductors 21, 23 of cable 2 are provided with respective insulating coverings 22, 24 as shown in FIG. 8. With this construction, the coaxial cable 2 can be installed from the rear end side in the direction of signal propagation in the waveguide 4. All the cells 34 are in a hexagonal shape. With this shape, the planar front-side surface of the dielectric substrate 31 can be efficiently filled with the cells.

Second Embodiment

Figure 6:
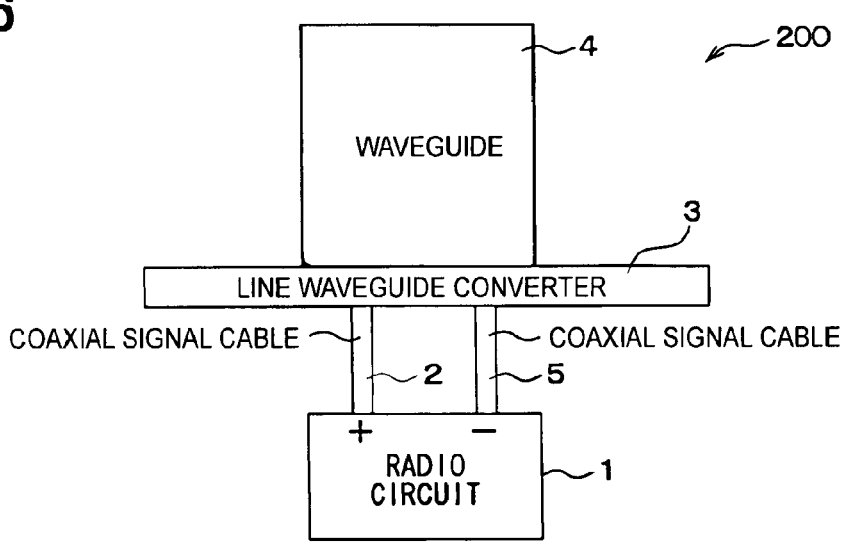
FIG. 6 is a schematic view of a communication device according to a second embodiment of the invention.

The second embodiment is different from the first embodiment in that, as illustrated in FIG. 6, two feeding points for the cells 34 are provided to carry out balanced feed. Specifically, a communication device 200 includes a signal line, which is also a coaxial cable 5, in addition to the radio circuit 1, the coaxial cable 2, the line-waveguide converter 3, and the waveguide 4. Feed from the radio circuit 1 to the line-waveguide converter 3 is carried out through not only the coaxial cable 2 but also the coaxial cable 5. The coaxial cable 5 is electrically connected with the radio circuit 1 and the line-waveguide converter 3.

Figure 7:
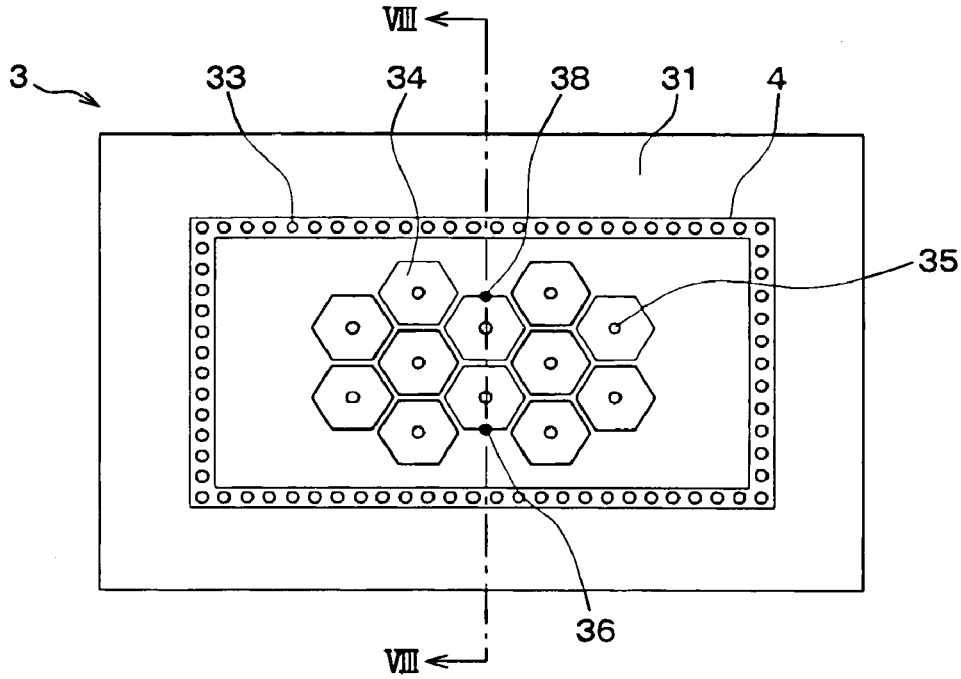
FIG. 7 is a plan view of a line-waveguide converter and a transparently depicted waveguide in the second embodiment.

As illustrated in FIG. 7, the coaxial cable 5 (FIG. 6) is connected to a second feeding point 38 on a feed cell (second feed cell) adjoining to the feed cell (first feed cell) provided with the first feeding point 36 of the cell 34. The second feed cell is similar with the first feed cell. That is, the second feed cell is situated in the center in the direction of the long sides of the waveguide 4 within the front-side surface of the dielectric substrate 31 perpendicular to the direction of signal propagation in the waveguide 4. The direction of the long sides of the waveguide is the horizontal direction in FIG. 7.

The direction of signal propagation in the waveguide is the direction toward the near side of FIG. 7.

The disposition of the second feeding point 38 on the second feed cell is disposed at an end of the second feed cell on a straight line. This straight line runs through the conduction point of the second feed cell and the conduction point of the first feed cell. The straight line is parallel with the direction of the short sides of the waveguide 4 within the front-side surface of the dielectric substrate 31 perpendicular to the direction of propagation in the waveguide 4. The direction of the short sides of the waveguide 4 is the vertical direction in FIG. 7. The first feeding point 36 and the second feeding point 38 are provided at the ends of the two adjoining cells, most distant from each other.

As illustrated in FIG. 8, the line-waveguide converter 3 further includes a through hole 42 (e.g., see FIG. 8) for the coaxial cable 5 (e.g., see FIG. 8). The through hole 42 for the coaxial cable 5 is so provided that it penetrates the dielectric substrate 31 from the backside surface to the front-side surface for connecting the coaxial cable 5 to the second feed cell. The through hole 42 for the line is so constructed that its planar disposition agrees with that of the second feeding point 38 of the second feed cell. An internal conductor 51 of the coaxial cable 5 is inserted into the through hole 42 for the line and brought into contact with the second feeding point 38. The conduction between the internal conductor 51 and the second feed cell is thereby provided. Electrical conduction is also established between an external conductor 53 around an insulator 52 covering the internal conductor 51 and the backside electrode 32. The external conductor 53 has its exterior covered with an insulator 54.

In the communication device 200 constructed as described above, the coaxial cables 2, 5 function as both poles for feeding from the radio circuit 1 to the line-waveguide converter 3. As described above, two adjoining ones of the multiple cells 34 are feed cells. In addition to the effect of the first embodiment, therefore, balanced feed can be achieved.

Third Embodiment

The third embodiment is different from the second embodiment in that the line for balanced feed from the radio circuit 1 to the line-waveguide converter 3 is not a coaxial cable but a coplanar line.

Figure 9:
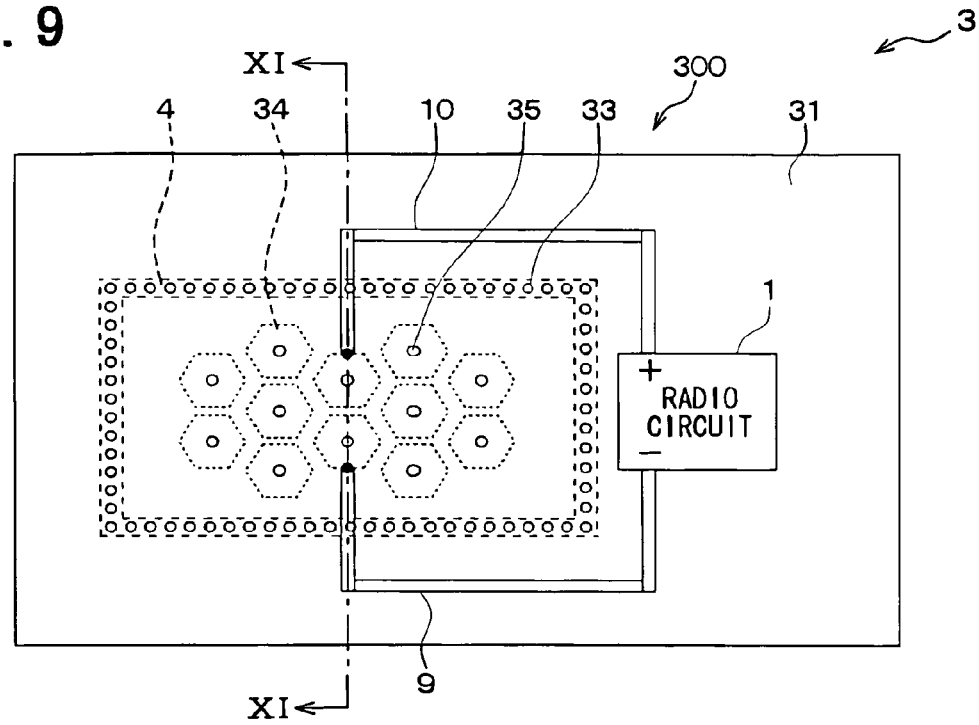
FIG. 9 is a schematic view of a communication device according to a third embodiment of the invention as viewed from the backside surface of a dielectric substrate.
Figure 10:
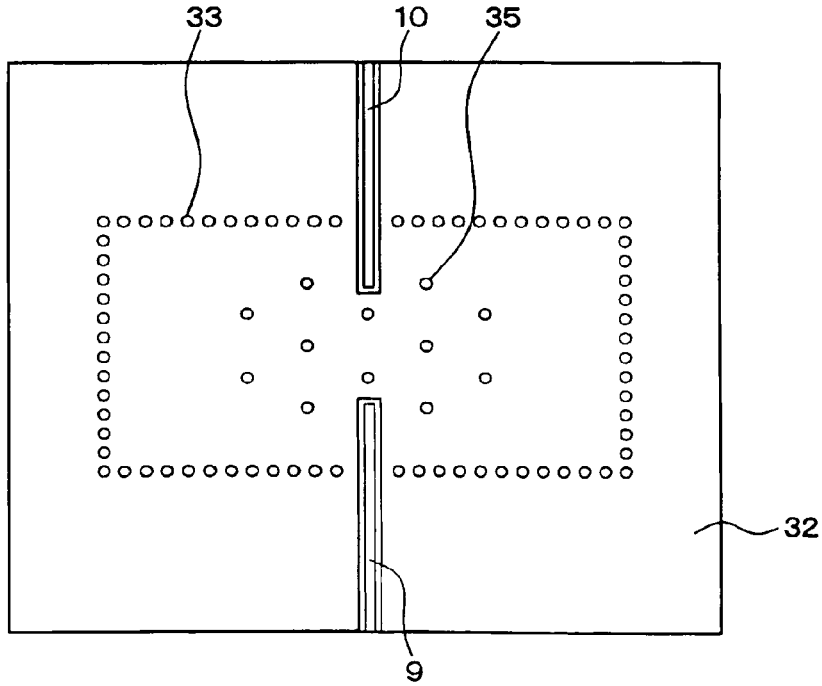
FIG. 10 is an enlarged view of a backside electrode and a line on the backside surface of a dielectric substrate in the third embodiment.

As illustrated in FIG. 9, a communication device 300 includes the radio circuit 1 mounted on the backside surface of the dielectric substrate 31. The radio circuit 1 is so constructed that it feeds power to the first and second feed cells of the line-waveguide converter 3 through the two coplanar lines 9, 10 (see also FIGS. 10 and 11) disposed on the backside surface. As illustrated in FIG. 10, the coplanar lines 9, 10 are provided on a same plane flush with the backside electrode 32 on the backside surface of the dielectric substrate 31 (FIG. 9) 50 that they are not in contact with the backside electrode 32.

Figure 11:
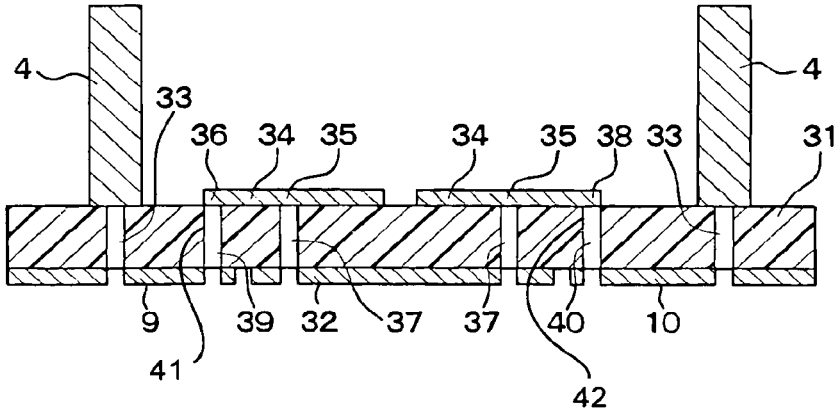
FIG. 11 is a sectional view of the communication device taken along line XI-XI in FIG. 9.

As illustrated in FIG. 11, the dielectric substrate 31 has through holes 39, 40 for the coplanar lines in the same positions as the through holes 41 and 42 for the coaxial lines in the second embodiment in place of them. Each of the through holes 39, 40 for the coplanar lines is so provided that it penetrates the dielectric substrate 31 from the backside surface to the front-side surface. The through holes 39, 40 for the coplanar lines are so constructed that the planar disposition of them respectively agrees with that of the first and second feeding points 36, 38 of the first and second feed cells. The inner walls of the through holes 39, 40 for the coplanar lines are covered with metal films that respectively have conduction to the coplanar lines 9, 10 on the backside surface and do not have conduction to the backside electrode 32. These metal films run to the front-side surface of the dielectric substrate 31 and respectively have conduction to the first feeding point 36 and the second feeding point 38. Thus, the conduction from the coplanar line 9 to the first feeding point 36 and the conduction from the coplanar line 10 to the second feeding point 38 are provided.

Fourth Embodiment

In the fourth embodiment, the line-waveguide converter 3 accomplishes unbalanced feed through the coplanar line 9 without the coplanar line 10 in the third embodiment.

Figure 12:
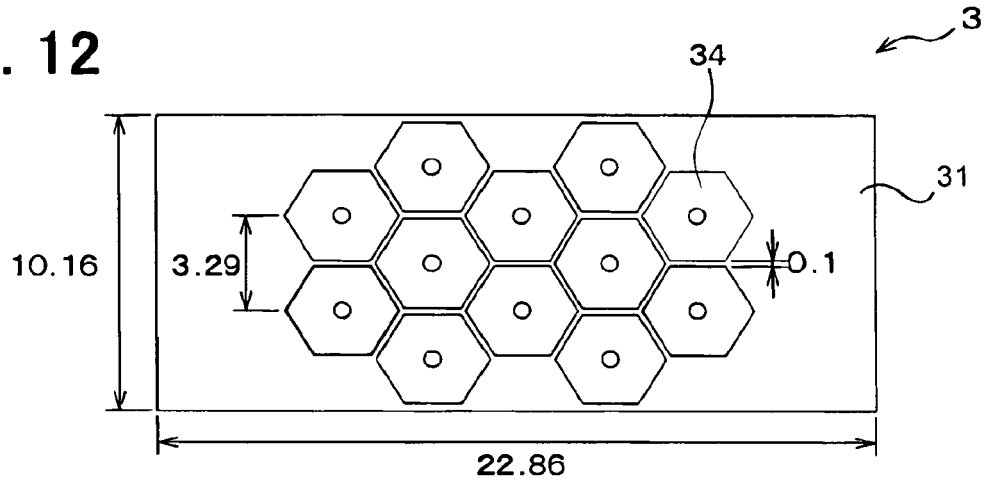
FIG. 12 is a plan view of cells and a waveguide of a communication device used in an experiment on a fourth embodiment of the invention.
Figure 13:
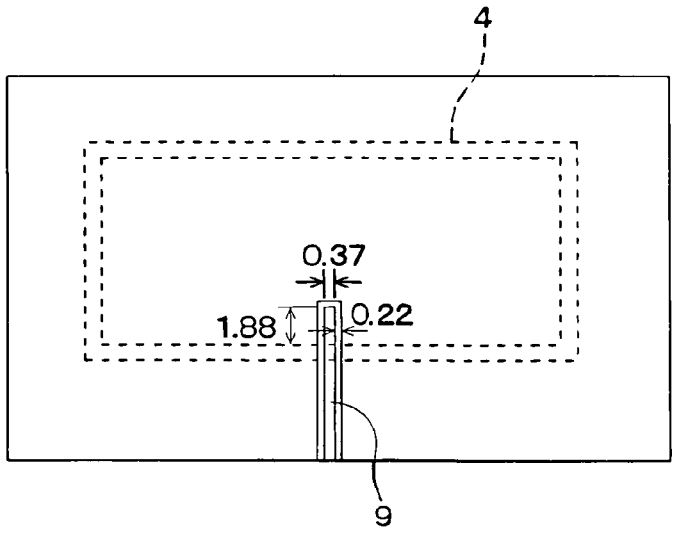
FIG. 13 is a plan view of a line and a backside electrode used in an experiment on the fourth embodiment.

FIG. 12 and FIG. 13 illustrate the dimensions of each part of the line-waveguide converter 3 used in an experiment on this embodiment. The dimensions of the portion of the dielectric substrate 31 inside the waveguide 4 (FIG. 13) are as follows (e.g., see FIG. 12): the length along the short sides of the waveguide 4 is 10.16 millimeters; and the length along the long sides is 22.86 millimeters. The distances between the centers of adjoining cells are uniformly 3.29 millimeters. The intervals between adjoining cells are uniformly 0.1 millimeter. The dielectric substrate 31 is 9.8 in relative permittivity and 0.76 millimeters in thickness (not shown).

Exemplary dimensions for the coplanar line feed are shown in FIG. 13. The width of the coplanar line 9 (FIG. 13) is 0.37 millimeters. The interval between the coplanar line 9 and the backside electrode 32 in the direction of the width of the coplanar line 9 is 0.22 millimeters. The length of the coplanar line 9 inside the waveguide 4 is 1.88 millimeters.

Figure 14:
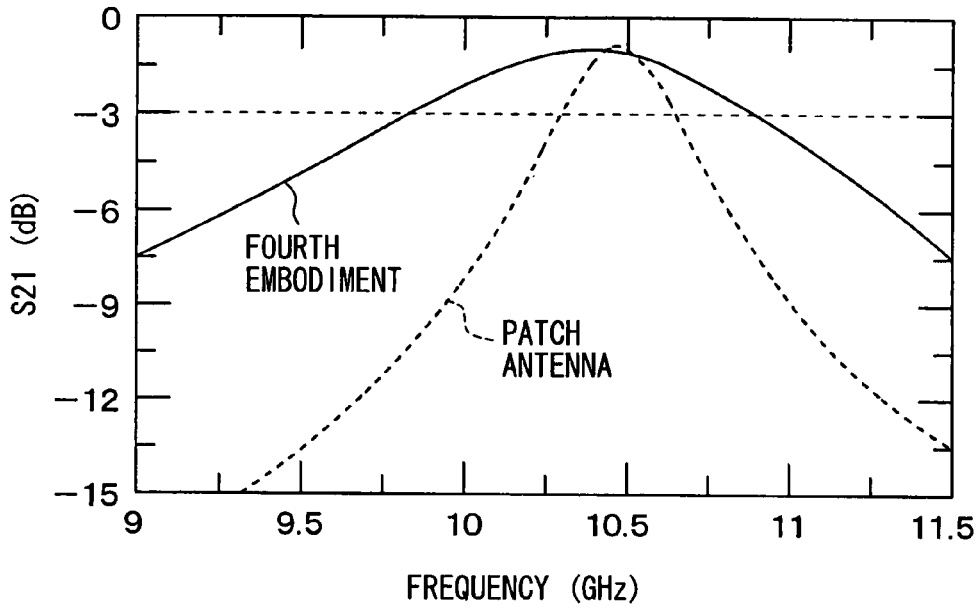
FIG. 14 is a graph indicating a result of simulation of the fourth embodiment.

FIG. 14 is a graph indicating the result of the simulation conducted under the above-mentioned conditions. The horizontal axis of the graph represents frequency in gigahertz, and the vertical axis represents transmission property S21 in decibel. The solid line in the graph indicates the result of the simulation of this embodiment (i.e., fourth), and the broken line indicates the result of a simulation of a line-waveguide converter using a patch antenna as a comparative example.

As indicated in the graph, the line-waveguide converter 3 in this embodiment has high transmission property over a wider frequency range than in the comparative example. Thus, the line-waveguide converter 3 in this embodiment can be used in a wider band range than conventional.

Fifth Embodiment

The fifth embodiment is different from the second embodiment in that the line for balanced feed from the radio circuit 1 to the line-waveguide converter 3 is not a coaxial line but a microstrip line.

Figure 15:
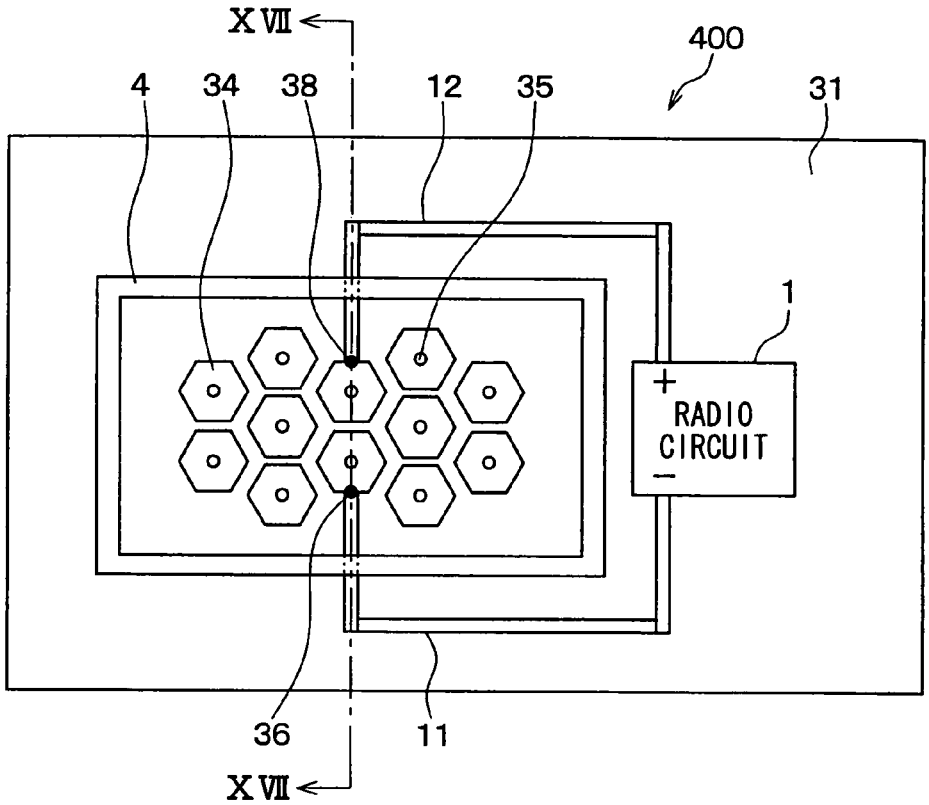
FIG. 15 is a schematic view of a communication device according to a fifth embodiment of the invention as viewed from the front-side surface of a dielectric substrate.
Figure 20:
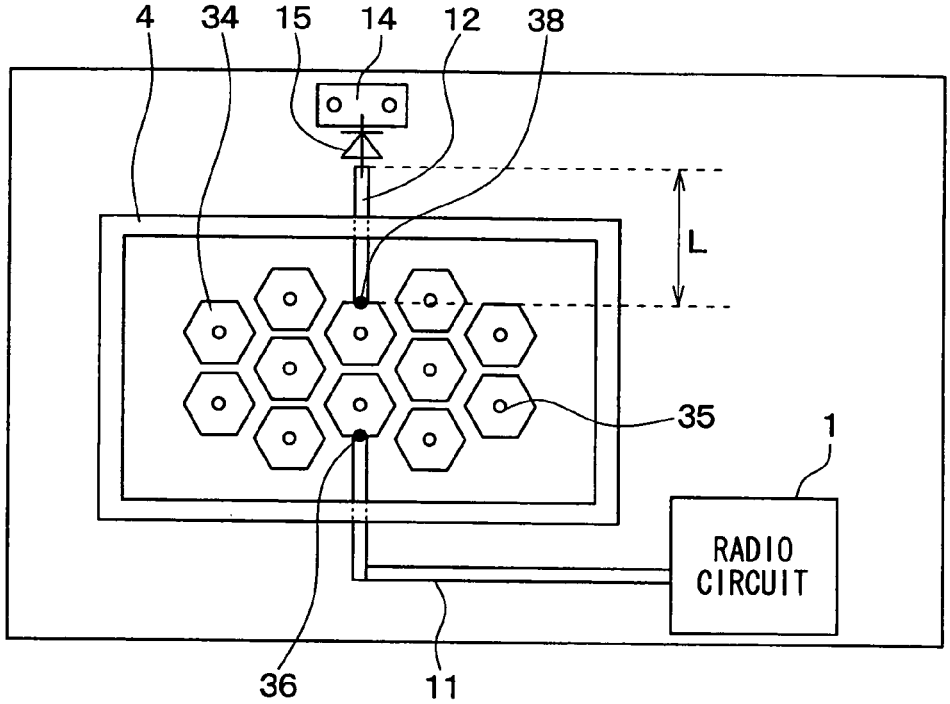
FIG. 20 is a schematic view illustrating the front-side surface of a line-waveguide converter and a waveguide according to a seventh embodiment of the invention.

As illustrated in FIG. 15, a communication device 400 has the radio circuit 1 mounted on the front-side surface of the dielectric substrate 31 (see also FIG. 20). The radio circuit 1 is so constructed that it feeds power to the first and second feed cells of the line-waveguide converter 3 through the two microstrip lines 11, 12 (see also FIGS. 16, 17 and 20) and first and second feeding points 36, 38, disposed on the front-side surface.

Figure 16:
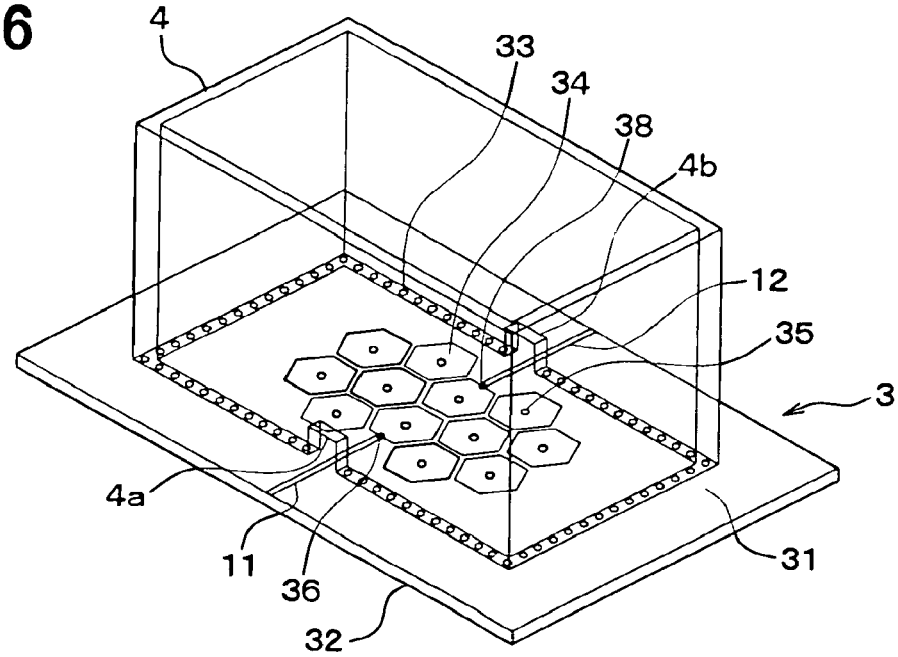
FIG. 16 is a perspective view transparently depicting a waveguide in the fifth embodiment.

As illustrated in FIG. 16, cuts 4*a*, 4*b* are formed in parts of the lower end of the waveguide 4. These cuts are formed to provide the front-side surface of the dielectric substrate 31 with openings for the microstrip line 11 and the microstrip line 12 to reach the respective feed cells. The microstrip lines 11 and 12 respectively reach the first and second feeding points 36 and 38 through the openings formed by the cuts 4*a* and 4*b*.

Figure 17:
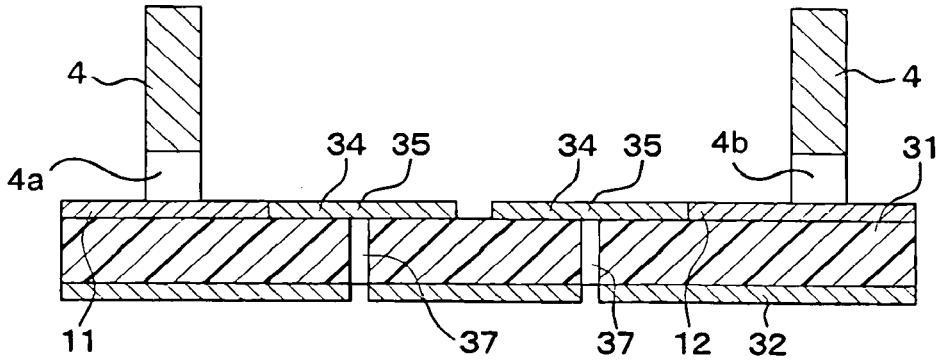
FIG. 17 is a sectional view taken along line XVII-XVII in FIG. 15.

As illustrated in FIG. 17, the dielectric substrate 31 does not have the through hole 41 or 42 for the coaxial line in the second embodiment. The cut 4*a* and the cut 4*b* are respectively astride the microstrip lines 11 and 12.

With this construction, the conduction from the microstrip line 11 to the first feeding point 36 and the conduction from the microstrip line 12 to the second feeding point 38 are provided.

Sixth Embodiment

Figure 18:
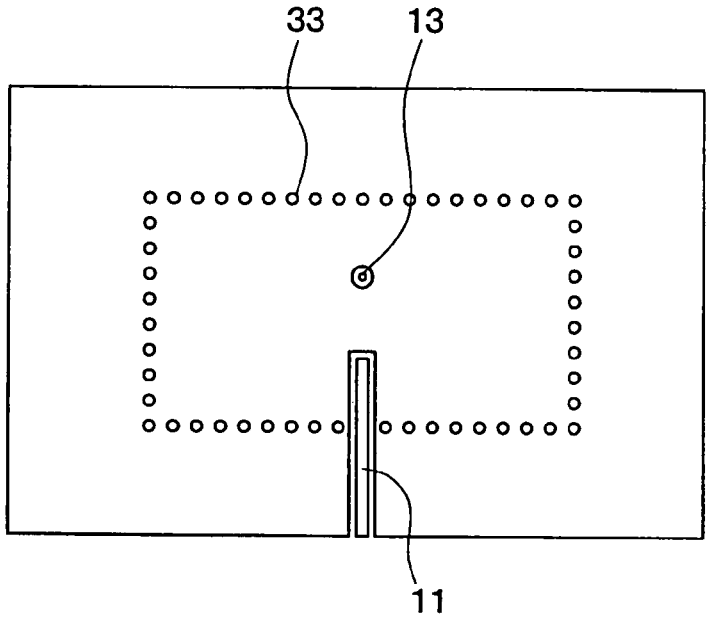
FIG. 18 is an enlarged view of the backside surface of a line-waveguide converter in a sixth embodiment of the invention.

The sixth embodiment is different from the third embodiment in that the coplanar line 12 in the third embodiment is replaced with an impedance control section 13 that makes it possible to set impedance as illustrated in FIG. 18 (in association with microstrip line 11). The impedance of the second feeding point 38 can be adjusted by connecting the impedance control section 13 to the second feeding point 38.

Figure 19:
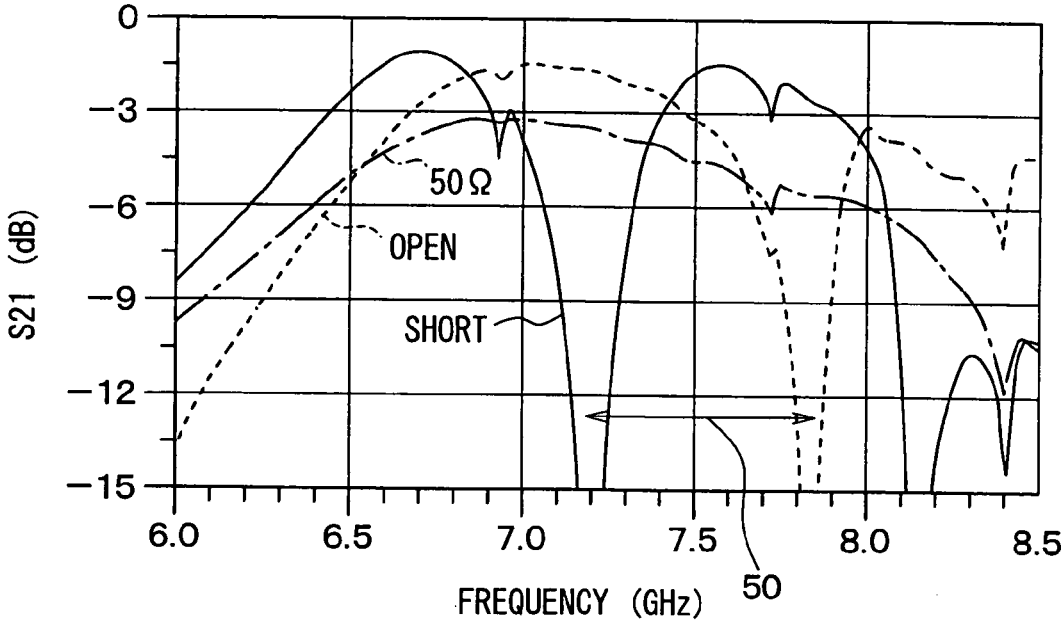
FIG. 19 is a graph indicating the transmission property of a line-waveguide converter at various impedances in the sixth embodiment.

FIG. 19 is a graph indicating the result of an experiment on the transmission property of the line-waveguide converter 3 with the load on the second feeding point 38 variably set by adjusting the impedance control section 13. The load on the second feeding point was set to short, open, and 50 ohm.

The dimensions of the portion of the dielectric substrate 31 inside the waveguide 4 used in this experiment are as follows: the length along the short sides of the waveguide 4 is 45 millimeters and the length along the long sides is 70 millimeters. The distances between the centers of adjoining cells are uniformly 4.7 millimeters. The intervals between adjoining cells are uniformly 0.1 millimeter. A WR-137 waveguide 4 (5.85 to 8.2 gigahertz) was used in the experiment.

The horizontal axis of the graph represents frequency in gigahertz, and the vertical axis represents transmission property S21 in decibel. The solid line, broken line, and alternate long and short dash line in the graph respectively indicate the results of the experiment with the load on the second feeding point set to short, open, and 50 ohm. For example, in the frequency band in proximity to 7.2 gigahertz, signals can be sufficiently transferred when the load is open but cannot be transferred when the load is short-circuited. In the 7.8 to 7.9 gigahertz band, conversely, signals can be sufficiently transferred when the load is short-circuited but radio emission cannot be implemented when the load is open.

As mentioned above, when the load on the impedance control section 13 is switched between open and short in some band, the line-waveguide converter is switched between substantially available and unavailable in that band. With this construction, the impedance control section 13 can be used as a switch for the line-waveguide converter 3.

When the impedance is continuously varied, as indicated by arrow 50, the frequency band in which radio emission is impossible is shifted. Therefore, when the impedance is adjusted when the line-waveguide converter 3 is manufactured, the following can be implemented: the transmission property in a frequency band in which it is desired to inhibit radio emission (for example, because it is desired to comply with regulations).

Seventh Embodiment

The seventh embodiment as illustrated in FIG. 20 is different from the sixth embodiment in that power fed from the radio circuit 1 is fed to the first feeding point 36 not by a coplanar line but by a microstrip line 11; and a microstrip line 12 and a diode 15 are attached to the second feeding point 38.

As illustrated in FIG. 20, the second feeding point 38 is connected with one end of the microstrip line 12 with a length L of $\lambda/4$, where $\lambda$ is a specific wavelength. The other end of the microstrip line 12 is connected to the anode of the diode 15. The cathode of the diode 15 is connected to ground 14. When the diode 15 is turned on in this case, the following takes place: the transmission property of the line-waveguide converter 3 at a frequency corresponding to the wavelength $\lambda$ is the same as when the impedance control section 13 is set to open in the sixth embodiment. When the diode 15 is turned off in this case, the following takes place: the transmission property of the line-waveguide converter 3 at a frequency corresponding to the wavelength $\lambda$ is the same as when the impedance control section 13 is set to short in the sixth embodiment.

When the length of the microstrip line 12 is adjusted, as mentioned above, the line-waveguide converter 3 can be switched between operative and inoperative in a specific frequency band by switching the diode 15 between on and off. That is, the diode 15 can be used as a switch in a frequency band corresponding to the length of the microstrip line 12.

Eighth Embodiment

Figure 21:
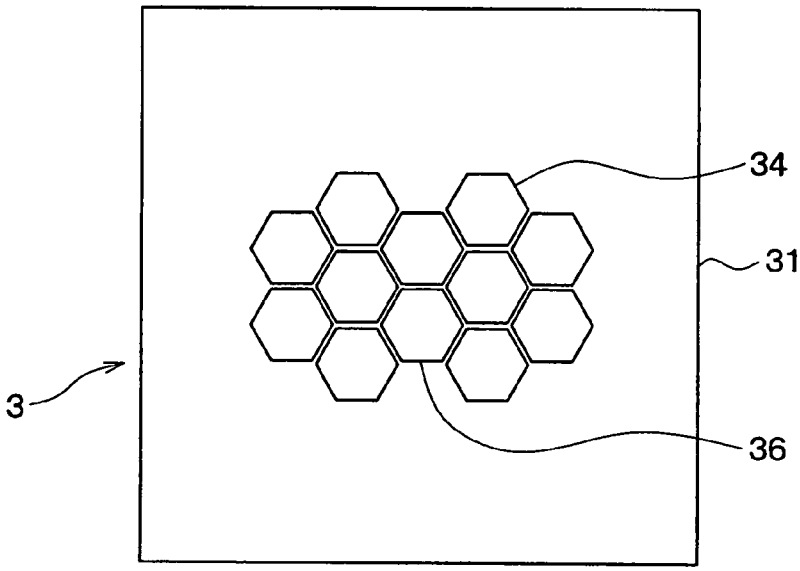
FIG. 21 is an enlarged view of a line-waveguide converter inside a waveguide according to an eighth embodiment of the invention.

The eighth embodiment as illustrated in FIG. 21 is different from the first embodiment in that: the line-waveguide converter 3 does not have through holes 37 for bringing the cells into conduction; and thus the cells 34 do not have a conduction point for conduction to the backside electrode 32 (not shown).

Figure 22:
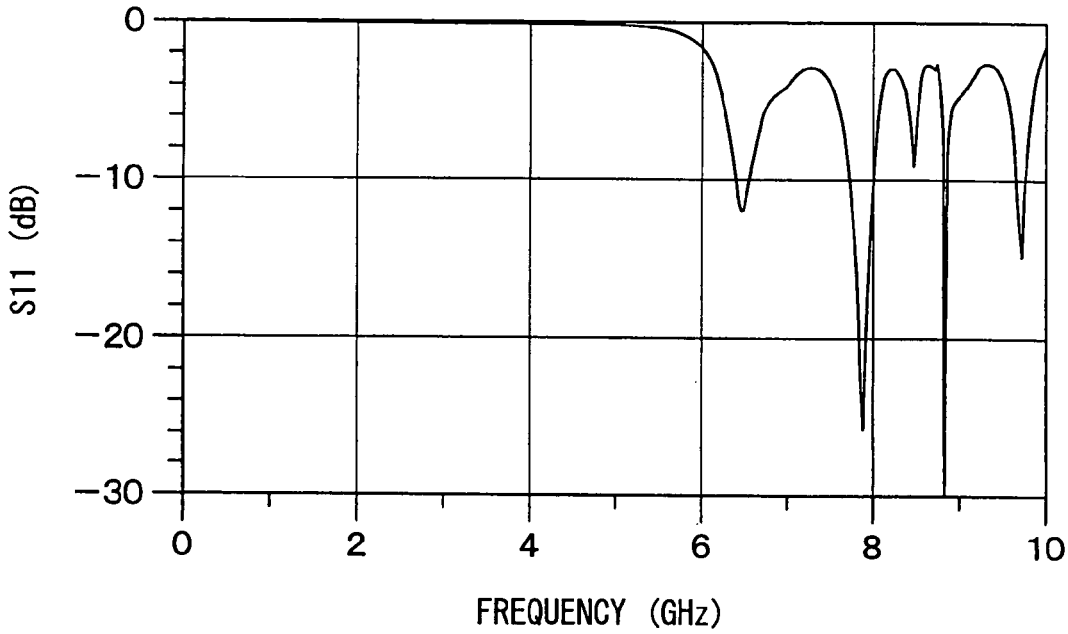
FIG. 22 is a graph indicating the result of a simulation of the eighth embodiment.

FIG. 22 is a graph indicating the result of a simulation of signal reflection property using a line-waveguide converter 3 in this embodiment. The horizontal axis of the graph represents frequency in gigahertz, and the vertical axis represents reflection property S11 in decibel. As is observed in the 6 to 10 gigahertz band, the line-waveguide converter 3 in this embodiment can also be used in a specific frequency band.

Other Embodiments

The above embodiments may be modified in various ways as described below as examples.

Figure 23:
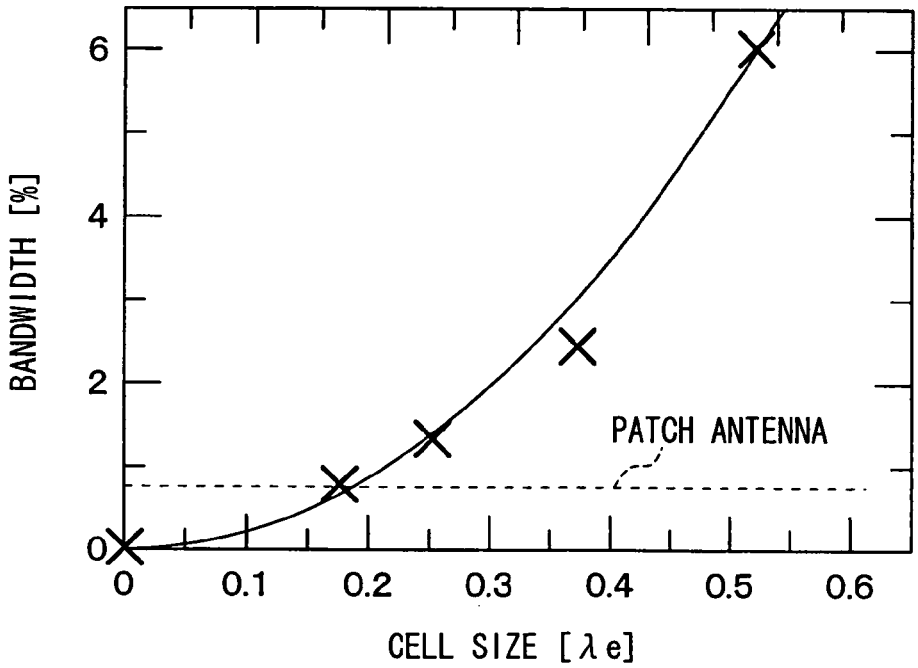
FIG. 23 is a graph indicating the relation between the size of hexagonal cells and bandwidth of the eighth embodiment.

The size of the cells 34 is not limited to those used in the above-mentioned simulations and experiments, and other various sizes may be used. FIG. 23 is a graph indicating the relation between the size of 12 individual hexagonal cells and bandwidth under the following condition: the relative permittivity of the dielectric substrate 31 is 9.8; the thickness of the dielectric substrate 31 is 1.27 millimeters; and the interval between cells is 0.3 millimeters. The horizontal axis of the graph represents a value provided by dividing the distance between the centers of adjoining cells by a wavelength $\lambda e$; and the vertical axis represents the bandwidth of the operating frequency of the line-waveguide converter 3. Here, the wavelength $\lambda e$ is a wavelength within the dielectric substrate 31 corresponding to the center frequency of the bandwidth. The bandwidth on the vertical axis is represented as a ratio to the center frequency. In the graph, the crosses represent values indicating the result of the above-mentioned simulation and the solid line is an approximate curve thereto; and the broken line indicates the result of an experiment on a line-waveguide converter using a patch antenna as a comparative example.

As is apparent from this graph, when the distance between the centers of adjoining cells exceeds 0.16 $\lambda e$, the frequency band of the line-waveguide converter 3 becomes wider than the case where the patch antenna is used.

Figure 24:
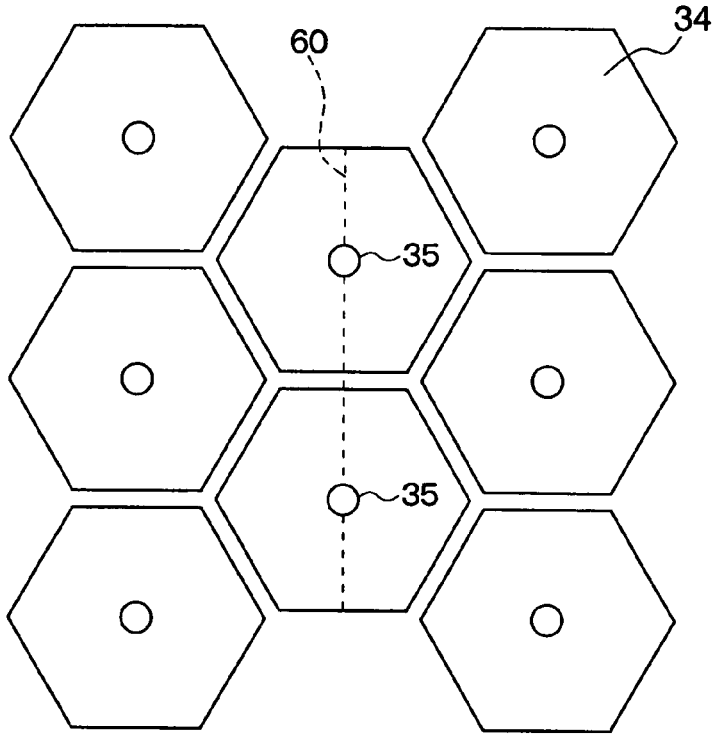
FIG. 24 is an enlarged view of a variation of the position of a feeding point.

As illustrated in FIG. 24, the feeding point on a feed cell need not be disposed at an end of the feed cell as in the first embodiment as long as it is situated on the following straight line 60: a straight line that runs through the conduction point 35 of that feed cell and is parallel with the short sides of the waveguide 4 within the front-side surface of the dielectric substrate 31 perpendicular to the direction of propagation in the waveguide 4. Even if the feeding point is not situated at an end of a feed cell, the following can be implemented as long as it is substantially situated on this straight line 60 (i.e., within the range of allowable error): the electric field of the electrodes can be excited in parallel with the electric field of the waveguide. Therefore, signals from the line to the waveguide can be efficiently converted. The input impedance of the line-waveguide converter 3 is lowered as the feeding point comes close to the conduction point 35 for conduction to the backside electrode 32. Therefore, the input impedance can be set to a desired value by shifting the feeding point on the straight line 60.

Figure 25:
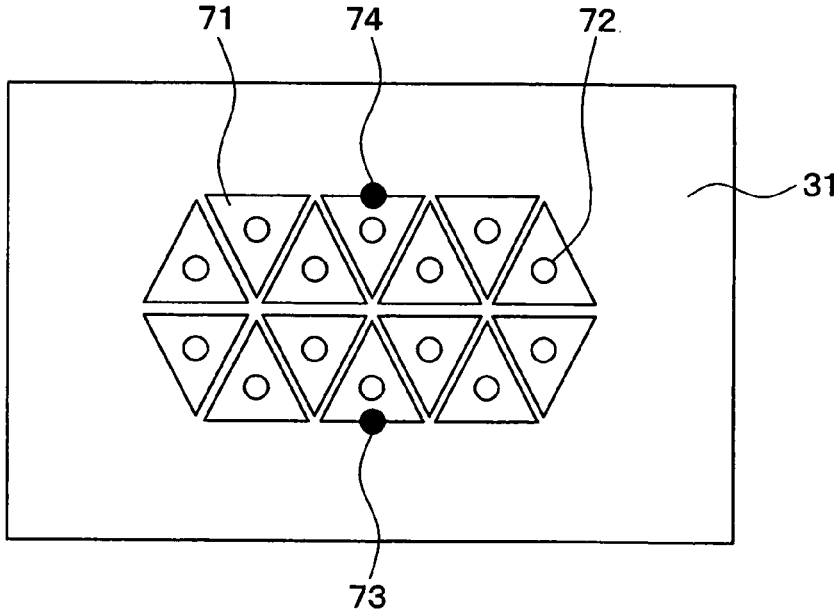
FIG. 25 is a plan view of cells which are triangular in shape.
Figure 26:
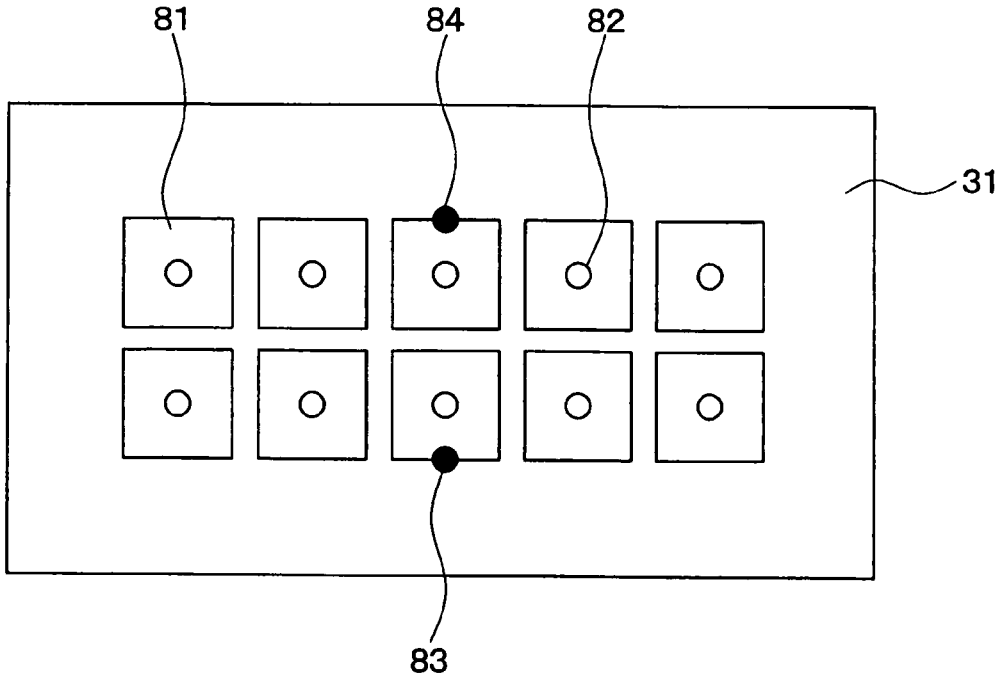
FIG. 26 is a plan view of cells which are rectangular in shape.

The multiple cells 34 need not be hexagonal. Instead, they may be realized as the multiple triangular cells 71 as illustrated in FIG. 25 or as the multiple rectangular cells 81 as illustrated in FIG. 26. Also in these cases, the central portions 72 in FIG. 25, 82 in FIG. 26 of these cells may be conduction points for conduction to the backside electrode 32 (not shown). Either or both of the two cells 73, 74 in FIG. 25, 83, 84 in FIG. 26 situated in the center in the direction of the long sides of the waveguide 4 within the front-side surface of the dielectric substrate 31 perpendicular to the direction of signal propagation in the waveguide 4 may be feed cells.

When cells have an identical shape and identical size and this shape is such that a plane can be filled with the cells, the plane can be efficiently filled with the cells. The cells need not be in these shapes. For example, they may be circular, or they may be in such a shape that they have fine recesses and projections at their ends.

The number and disposition of the cells 34 need not be as in the above embodiments. There is no restriction on the number or disposition of them as long as they are in substantially identical shape and substantially identical size and there are substantial identical intervals between adjoining cells.

The conduction points 35 for conduction to the backside electrode 32 need not be in the center of the respective cells 34. The waveguide 4 may be considered as part of the line-waveguide converter 3.

What is claimed is:

1. A line-waveguide converter comprising:

a dielectric substrate;

a first face electric conductor disposed on a first face of the dielectric substrate;

a waveguide attached to a second face of the dielectric substrate opposite the first face and having electrical conduction to the first face electric conductor; and a plurality of electrodes disposed inside the waveguide on the second face, wherein the plurality of electrodes are identical in shape and size, wherein the intervals between adjoining electrodes of the plurality of electrodes are identical, and wherein at least one electrode of the plurality of electrodes is a feed electrode to which power is fed from a line.

2. The line-waveguide converter of claim 1, wherein:

the dielectric substrate is provided with a plurality of through holes, and the plurality of electrodes have conduction to the first face electric conductor via the plurality of through holes.

3. The line-waveguide converter of claim 2, wherein:

the plurality of through holes respectively agree in position with the central portions of the plurality of electrodes.

4. The line-waveguide converter of claim 2, wherein:

the feed electrode is a point on a straight line running through a point at which conduction to the first face electric conductor is provided and parallel with short sides of the waveguide within a plane perpendicular to the direction of signal propagation in the waveguide, and the line has conduction to the feed electrode.

5. The line-waveguide converter of claim 1, wherein:

the plurality of electrodes do not have conduction to the first face electric conductor.

6. The line-waveguide converter of claim 1, wherein:

each of two adjoining electrodes of the plurality of electrodes is the feed electrode.

7. The line-waveguide converter of claim 6, further comprising:

a load connected to either of the two adjoining electrodes of the feed electrode.

8. The line-waveguide converter of claim 7, wherein:

the load is switchable between open state and short-circuited state.

9. The line-waveguide converter of claim 1, wherein:

of the plurality of electrodes, an electrode situated in the central portion in the direction of the long sides of the waveguide within a plane perpendicular to the direction of signal propagation in the waveguide is the feed electrode which is fed with power from the line.

10. The line-waveguide converter of claim 1, wherein:

the line is an internal conductor of a coaxial line;

an external conductor of the coaxial line has conduction to the first face electric conductor; and the internal conductor has conduction to the feed electrode.

11. The line-waveguide converter of claim 1, wherein:

the line is a microstrip line disposed on the second face;

the waveguide is provided with a cut for providing an opening between the second face and the waveguide; and the microstrip line runs through the opening and has conduction to the feed electrode.

12. The line-waveguide converter of claim 1, wherein:

the line is a coplanar line provided on the first face; and the coplanar line runs from the first face and through a through hole formed in the dielectric substrate, and has conduction to the feed electrode.

13. The line-waveguide converter of claim 1, wherein:

the plurality of electrodes are in a triangular shape.

14. The line-waveguide converter of claim 1, wherein:

the plurality of electrodes are in a rectangular shape.

15. The line-waveguide converter of claim 1, wherein:

the plurality of electrodes are in a hexagonal shape.

16. The line-waveguide converter of claim 1, wherein:

the distance between the centers of adjoining electrodes of the plurality of electrodes is 0.16 or more times a wavelength within the dielectric substrate corresponding to an operating frequency of the line-waveguide converter.

17. A radio transmitting device comprising:

the line-waveguide converter of claim 1.

* * * * *